US009514626B2

(12) United States Patent
Wu et al.

(10) Patent No.: US 9,514,626 B2
(45) Date of Patent: Dec. 6, 2016

(54) DROWSY DRIVER DETECTION SYSTEM

(71) Applicant: L&P PROPERTY MANAGEMENT COMPANY, South Gate, CA (US)

(72) Inventors: Riheng Wu, Carthage, MO (US); Jason Turner, Joplin, MO (US); Caleb Browning, Carthage, MO (US); Travis Brummett, Carthage, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 114 days.

(21) Appl. No.: 14/614,808

(22) Filed: Feb. 5, 2015

(65) Prior Publication Data

US 2015/0154845 A1 Jun. 4, 2015

Related U.S. Application Data

(63) Continuation of application No. 13/379,763, filed as application No. PCT/US2010/039701 on Jun. 23, 2010, now Pat. No. 8,957,779.

(60) Provisional application No. 61/219,639, filed on Jun. 23, 2009.

(51) Int. Cl.
*G08B 23/00* (2006.01)
*G08B 21/06* (2006.01)

(52) U.S. Cl.
CPC ..... *G08B 21/06* (2013.01); *G08B 23/00* (2013.01)

(58) Field of Classification Search
CPC . G08B 21/06; G08B 23/00; B60W 2040/0818
USPC ..... 340/575, 576, 573.1; 180/271
See application file for complete search history.

(56) References Cited

U.S. PATENT DOCUMENTS 4,502,122 A * 2/1985 Yanagishima ..... G08B 21/06 180/272
5,465,079 A 11/1995 Bouchard et al.
5,570,698 A 11/1996 Liang et al.
5,689,241 A 11/1997 Clarke, Sr. et al.
5,691,693 A * 11/1997 Kithil ..... B60N 2/002 180/272
5,786,765 A 7/1998 Kumakura et al.
5,802,479 A 9/1998 Kithil
5,900,819 A 5/1999 Kyrtsos
5,917,415 A 6/1999 Atlas
(Continued)

OTHER PUBLICATIONS

Bartlett, Marian Stewart et al., "Chapter 25: Automated Facial Expression Measurement: Recent Applications to Basic Research in Human Behavior, Learning and Education"The Oxford Handbook of Face Perception, Eds. Andrew J. Calder et al., Oxford University Press Inc, (New York) pp. 489-513 (2011).

*Primary Examiner* — Phung Nguyen
(74) *Attorney, Agent, or Firm* — Michael Best & Friedrich LLP

(57) ABSTRACT

A method of detecting impairment of a driver of a vehicle. The method includes sensing, using a sensor, a position of the driver's head at a plurality of time points; determining, using a microprocessor, changes in the position of the driver's head between the plurality of time points; evaluating, using a microprocessor, whether the changes in the position of the driver's head between the plurality of time points exhibit at least one of a periodic and a quasi-periodic pattern; determining whether the driver is impaired based on the pattern of the changes in the position of the driver's head; and if the driver is impaired, alerting the driver using an alarm.

18 Claims, 18 Drawing Sheets

(56) References Cited

U.S. PATENT DOCUMENTS

| | | | | |
|---|---|---|---|---|
| 6,091,334 | A | 7/2000 | Galiana et al. | |
| 6,130,617 | A | 10/2000 | Yeo | |
| 6,154,123 | A | 11/2000 | Kleinberg | |
| 6,239,707 | B1 | 5/2001 | Park | |
| 6,265,978 | B1 | 7/2001 | Atlas | |
| 6,324,453 | B1 | 11/2001 | Breed et al. | |
| 6,353,396 | B1 | 3/2002 | Atlas | |
| 6,392,550 | B1 | 5/2002 | Najor | |
| 6,496,117 | B2 | 12/2002 | Gutta et al. | |
| 6,497,658 | B2 | 12/2002 | Roizen et al. | |
| 6,511,424 | B1 | 1/2003 | Moore-Ede et al. | |
| 6,513,833 | B2 * | 2/2003 | Breed | B60J 10/00 180/272 |
| 6,542,081 | B2 | 4/2003 | Torch | |
| 6,575,902 | B1 | 6/2003 | Burton | |
| 6,661,345 | B1 | 12/2003 | Bevan et al. | |
| 6,736,231 | B2 | 5/2004 | Breed et al. | |
| 6,756,903 | B2 | 6/2004 | Omry et al. | |
| 6,822,573 | B2 * | 11/2004 | Basir | G08B 21/06 280/735 |
| 6,927,694 | B1 | 8/2005 | Smith et al. | |
| 7,027,621 | B1 | 4/2006 | Prokoski | |
| 7,187,292 | B2 | 3/2007 | Hayashi et al. | |
| 7,206,631 | B2 | 4/2007 | Kawachi et al. | |
| 7,463,157 | B2 | 12/2008 | Victor et al. | |
| 2003/0140771 | A1 | 7/2003 | Ohshima | |
| 2005/0249473 | A1 | 11/2005 | Page et al. | |
| 2006/0283652 | A1 | 12/2006 | Yanai et al. | |
| 2007/0008151 | A1 * | 1/2007 | Victor | A61B 5/11 340/573.1 |
| 2008/0068187 | A1 | 3/2008 | Bonefas | |
| 2008/0266552 | A1 | 10/2008 | Malawey et al. | |
| 2011/0043350 | A1 | 2/2011 | Ben David | |
| 2011/0060260 | A1 | 3/2011 | Siegler | |
| 2011/0121976 | A1 | 5/2011 | Johns | |
| 2013/0217352 | A1 | 8/2013 | Pan | |
| 2014/0168399 | A1 | 6/2014 | Plummer | |

* cited by examiner

DROWSY DRIVER DETECTION SYSTEM

CROSS-REFERENCE TO RELATED APPLICATIONS

This application is a continuation of U.S. patent application Ser. No. 13/379,763, filed Mar. 13, 2012, which is the United States National Stage of International Patent Application No. PCT/US2010/039701, filed on Jun. 23, 2010, which claims priority to U.S. Provisional Application No. 61/219,639, filed Jun. 23, 2009, the contents of which are incorporated herein by reference in their entirety.

BACKGROUND

Field of the Invention

The present invention relates to an apparatus, a system, and a method for detecting whether a driver of a vehicle is impaired, for example by drowsiness.

Background of the Invention

If a driver of a vehicle becomes sleepy or is impaired in other ways, this can adversely affect driving performance. Although various methods and systems have been proposed for addressing this problem, none are satisfactory. Some of the current methods involve sensing the driver's state of awareness using a sensor that has contact with the driver's body. Other methods require the driver's head to be in a certain orientation. Still other methods require visualization of the driver's eyes. However, each of these methods has significant drawbacks.

SUMMARY OF THE INVENTION

The invention provides, among other things, a method of detecting impairment of a driver of a vehicle. The method includes sensing, using a sensor, a position of the driver's head at a plurality of time points; determining, using a microprocessor, changes in the position of the driver's head between the plurality of time points; evaluating, using a microprocessor, whether the changes in the position of the driver's head between the plurality of time points exhibit at least one of a periodic and a quasi-periodic pattern; determining whether the driver is impaired based on the pattern of the changes in the position of the driver's head; and if the driver is impaired, alerting the driver using an alarm.

The invention also provides a system for detecting impairment of a driver of a vehicle. The system includes a sensor for sensing a position of the driver's head at a plurality of time points, an alarm for altering the driver, and a microprocessor. The microprocessor is configured to determine changes in the position of the driver's head between the plurality of time points, evaluate whether the changes in the position of the driver's head between the plurality of time points exhibit at least one of a periodic and a quasi-periodic pattern, determine whether the driver is impaired based on the pattern of the changes in the position of the driver's head, and, if the driver is impaired, alert the driver using the alarm.

BRIEF DESCRIPTION OF THE DRAWINGS

Various aspects of the invention will become apparent by consideration of the detailed description and accompanying drawings.

DETAILED DESCRIPTION

Figure 1:
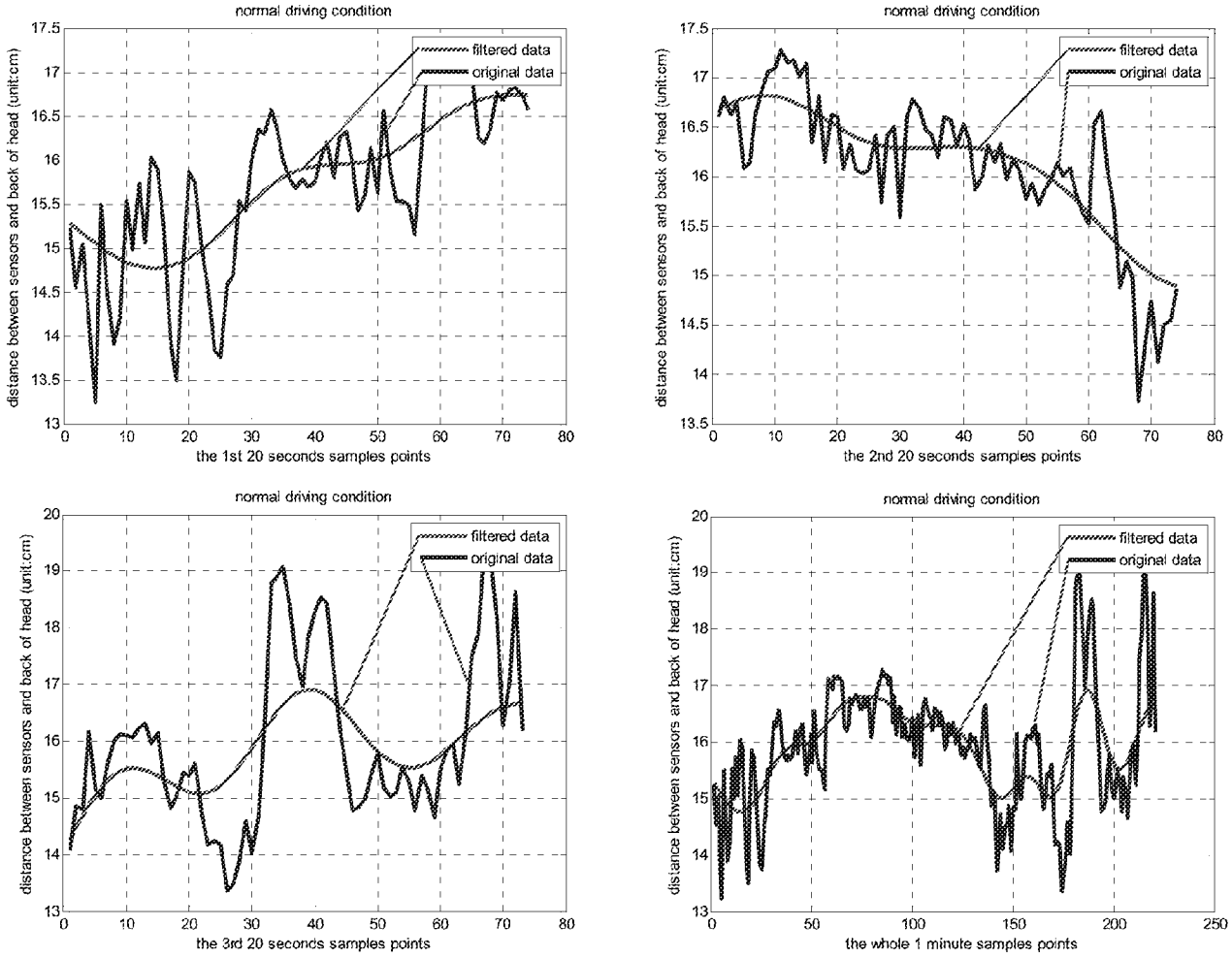
FIG. 1 shows ultrasonic sensor data acquired from an unimpaired driver under normal conditions.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

In various embodiments the present invention provides apparatus, systems, and methods to detect impaired drivers, including drowsy drivers. In one embodiment, an ultrasonic transceiver is positioned inside of the car headrest and aimed at the back of the driver's head in order to detect changes in the driver's head position. Statistical signal processing algorithms are then applied in both time and frequency domains to the acquired data to analyze the patterns of head motion to determine whether the driver is drowsy.

A driver who is not impaired, for example a driver who is not drowsy, does not show a regular pattern of head motions. Once the driver falls into a state of fatigue, however, head motion patterns such as nods become apparent. Accordingly, in various embodiments of the present invention, the above-mentioned statistical signal processing analysis is used to analyze and judge a driver's state and degree of fatigue or other impairment.

The unique intrinsic feature of head motion indicating occupant drowsiness is its quasi-periodicity or periodicity, which means, for example, that the drowsy driver's head will show a regular motion from front to back or vice versa, as opposed to the irregularity of other random head motions that occur when the driver is in an unimpaired driving state.

Simulation results such as those disclosed herein indicate that the auto-correlation function is a good metric for showing periodic head motions even with a low signal-to-noise ratio, i.e., if a signal is a periodic or quasi-periodic signal, its auto-correlation function will show its periodicity or quasi-periodicity. In addition, the variance and dispersion coefficients also display this unique feature.

Data analysis can also be performed in the frequency domain. The main metrics are power spectrum density and high-order spectrum estimation theory.

The data analysis methods disclosed herein have sufficient capabilities to describe the features of the signals corresponding to random head movements that are collected in embodiments of the present invention. From simulation results generated by the present inventors, it has been determined that power spectral density and high-order spectrum estimation can discern a periodic or quasi-periodic signal in the frequency domain that is consistent with previous results obtained from analyses in the time domain. Experimental results show that the preceding methods can obtain satisfying results using the comprehensive information mining techniques in both the time and frequency domains.

Embodiments of the present invention utilize ultrasonic detection of a vehicle driver's head motion to measure, analyze and judge the driver's fatigue state and degree of impairment. The principle of the method is to use ultrasonic sensors to continuously detect the relative distance of a certain fixed small area on the subject driver's head from a particular location, such as the head rest of the driver's seat. The ultrasonic sensors may be located in, on, or near various places in the vehicle, including for example in the headrest or other portions of the seat or seatback, the dashboard, the steering wheel, the visor, or the roof, to name a few possibilities. In various embodiments, the same fixed point on the back of the driver's head is detected throughout the measurements. The acquired relative distance data is then analyzed using a digital signal processor (DSP) to compute, analyze, and determine motion law of the point in time and frequency domains.

In various embodiments, the algorithms disclosed herein are applied in either the time domain or the frequency domain, and simulation data were obtained from actual measurement values.

In some embodiments, data analyses were performed in the time domain, which includes calculating variance, standard deviation, dispersion coefficient, and auto-correlation function. These metrics were selected because they can extract the characteristic values of random signals according to statistical signal processing theory, where the characteristic values are indicative of the distinctions between different signals.

In particular, the dispersion coefficient and the auto-correlation function are important metrics for these time domain analyses. The dispersion coefficient reflects the relative degree of dispersion of a group of data by itself, which is comparable with other distinct group data, because the metric unit is uniform. The greater the value is, the higher the dispersion degree. The purpose of the auto-correlation function is to analyze and judge whether or not a group of discrete data hold periodicity or quasi-periodicity dependent on the signal power.

Performance comparisons and analyses are also conducted in the frequency domain. The main frequency-domain metrics that are considered are power spectrum analysis, frequency spectrum analysis, and high-order spectrum estimation theory. The methods disclosed herein have sufficient capabilities to describe the features of random processes and random signals in the data that is collected according to the present invention.

The examples disclosed herein are based on four different driving cases: regular normal driving, random normal driving, drowsy driving and normal-drowsy driving. These are organized into two sections according to sample rate and measurement time.

FIG. 1 shows head movement data collected at a sample rate of 3.8 Hz and with a total measurement time of 1 min. To reduce the noise of collected signals, sliding window average filtering was used to implement the sample process in various embodiments of the invention. In other words, five data points were measured in a consecutive time section, and the arithmetic mean value was calculated to produce a single time measurement. The details of four different driving cases and technical schemes are listed in Table 1 below.

TABLE 1

| | | | |
|---|---|---|---|
| regular normal driving | the $1^{st}$ 20 s data | the $2^{nd}$ 20 s data | the $3^{rd}$ 20 s data |
| random normal driving | the $1^{st}$ 20 s data | the $2^{nd}$ 20 s data | the $3^{rd}$ 20 s data |
| drowsy driving | the $1^{st}$ 20 s data | the $2^{nd}$ 20 s data | the $3^{rd}$ 20 s data |
| normal-drowsy driving | the $1^{st}$ 20 s data | the $2^{nd}$ 20 s data | the $3^{rd}$ 20 s data |

In FIG. 1 it can be seen that the raw measurement data (jagged lines) have relatively large fluctuations, even using smooth window average filtering. Several factors may contribute to these fluctuations. Firstly, ultrasonic sensors are sensitive and highly dependent on how large, flat, and hard the reflected surface is. In the present case, factors such as the driver's loose hair can have a random shape and density, and thus may bring about significant measurement variability. In other embodiments, various ultrasonic frequencies are employed which penetrate softer objects such as hair so as to obtain a less noisy signal. In various embodiments the ultrasonic energy tracks a position on the subject driver's skull.

Another factor that can contribute to noise is that the measurement point of the ultrasonic sensors may fluctuate in space. These fluctuations may be due to factors such as changes in air temperature (affecting the speed of the ultrasonic energy), in which case including a temperature sensor can be used to compensate for air temperature variations.

In some embodiments, data were collected for one minute at 3.8 Hz and the measurements from the first twenty seconds (1st group), middle twenty seconds (2nd group), and last twenty seconds (3rd group) were analyzed. In other embodiments, data were collected for two or three minutes, in which case the groups were divided up into 40-second or 60-second intervals, respectively. Other time-based divisions of the data are also possible.

Figure 2:
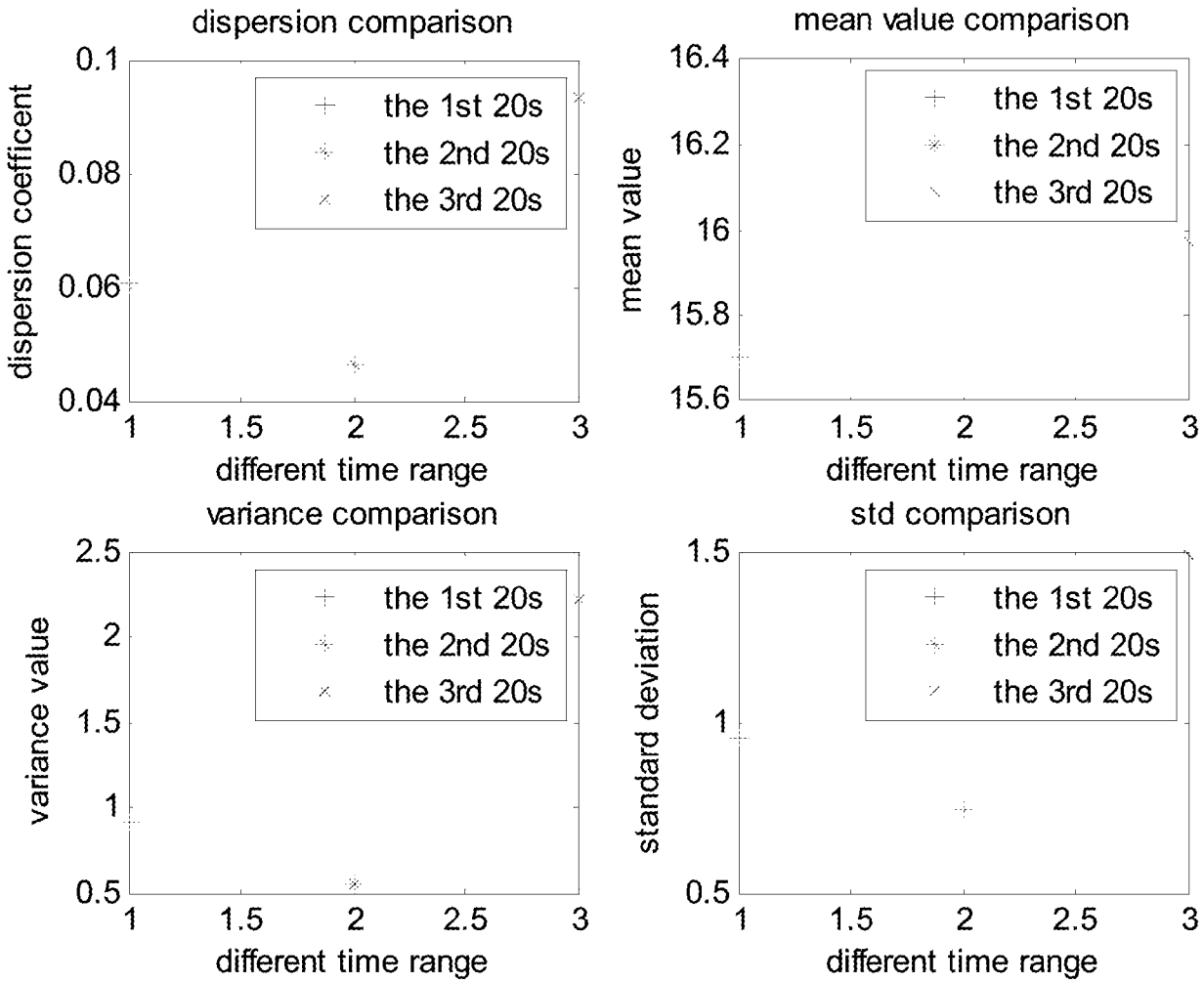
FIG. 2 shows a dispersion coefficient in the regular normal driving condition.

Dispersion coefficients were calculated using the data of FIG. 1. FIG. 2 shows that dispersion coefficients within different time ranges have evident differences, the 3rd group data have the biggest value, the 2nd one have the smallest one, which denotes the 3rd group data have relative big deviation. The extreme difference value is 0.05, and the trend is similar to the individual variance and standard deviation.

Figure 3:
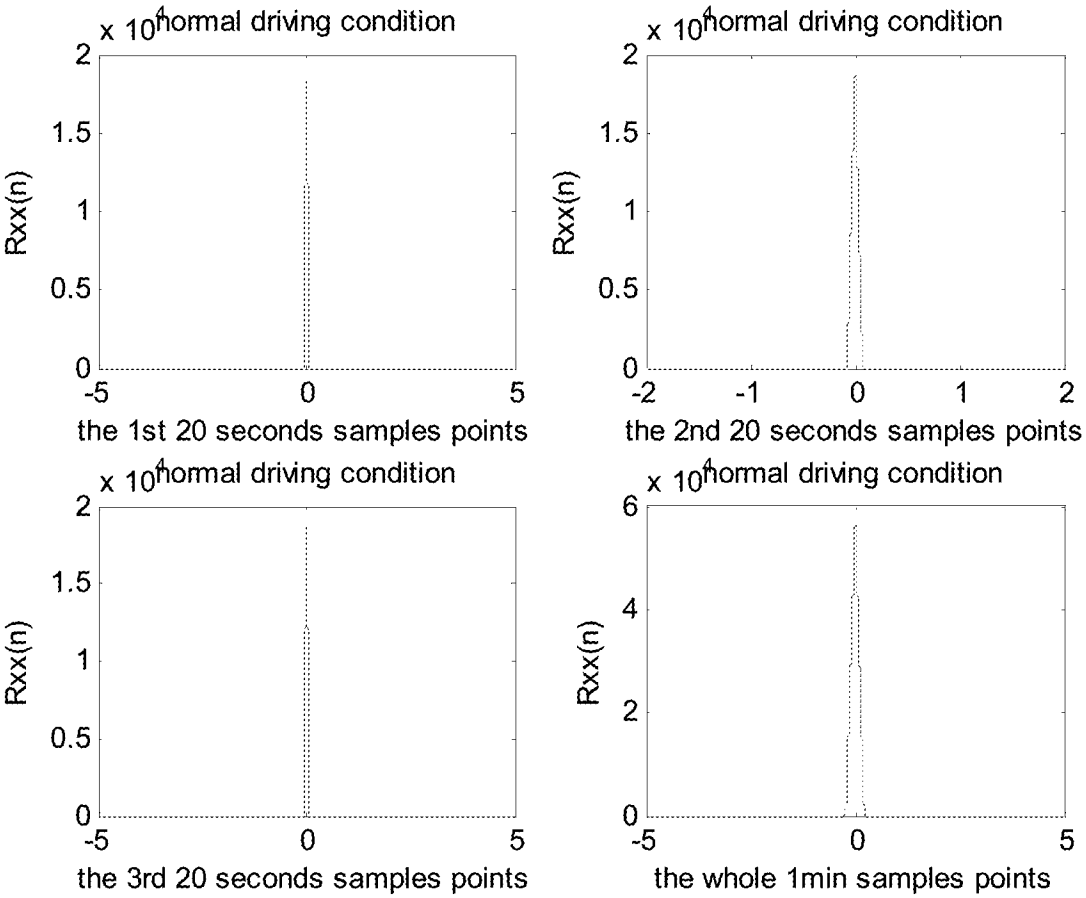
FIG. 3 shows an auto-correlation function in the regular normal driving condition.

FIG. 3 presents individual auto-correlation results corresponding to the data of FIG. 1. There is no periodic signal evident in the normal driving case, instead the signals resemble those of random, white noise.

The second group of simulation data comes from three different time ranges (1 min, 2 min, 3 min respectively), with four different driving simulation cases for each time range (regular normal, random normal, normal-fatigue, and fatigue driving), where the sampling rate for each group data are set to 14.4 Hz, which satisfies the Shannon Sample theorem. In this experiment, the window average filtering is removed when implementing the similar procedure. The details of the technical proposal are listed in Table 2 below.

TABLE 2

| | regular normal | | | random normal | | | normal-fatigue | | | fatigue driving | | |
|---|---|---|---|---|---|---|---|---|---|---|---|---|
| 1 min test | $1^{st}$ | $2^{nd}$ | $3^{rd}$ | $1^{st}$ | $2^{nd}$ | $3^{rd}$ | $1^{st}$ | $2^{nd}$ | $3^{rd}$ | $1^{st}$ | $2^{nd}$ | $3^{rd}$ |
| data | 20 s | 20 s | 20 s | 20 s | 20 s | 20 s | 20 s | 20 s | 20 s | 20 s | 20 s | 20 s |
| 2 min test | $1^{st}$ | $2^{nd}$ | $3^{rd}$ | $1^{st}$ | $2^{nd}$ | $3^{rd}$ | $1^{st}$ | $2^{nd}$ | $3^{rd}$ | $1^{st}$ | $2^{nd}$ | $3^{rd}$ |
| data | 40 s | 40 s | 40 s | 40 s | 40 s | 40 s | 40 s | 40 s | 40 s | 40 s | 40 s | 40 s |
| 3 min test | $1^{st}$ | $2^{nd}$ | $3^{rd}$ | $1^{st}$ | $2^{nd}$ | $3^{rd}$ | $1^{st}$ | $2^{nd}$ | $3^{rd}$ | $1^{st}$ | $2^{nd}$ | $3^{rd}$ |
| data | 60 s | 60 s | 60 s | 60 s | 60 s | 60 s | 60 s | 60 s | 60 s | 60 s | 60 s | 60 s |

As for the random normal driving condition (i.e. head movements of an unimpaired driver), it shows the similar curve and characteristics of a regular case. Our emphasis will be placed on drowsy driving condition.

Figure 4:
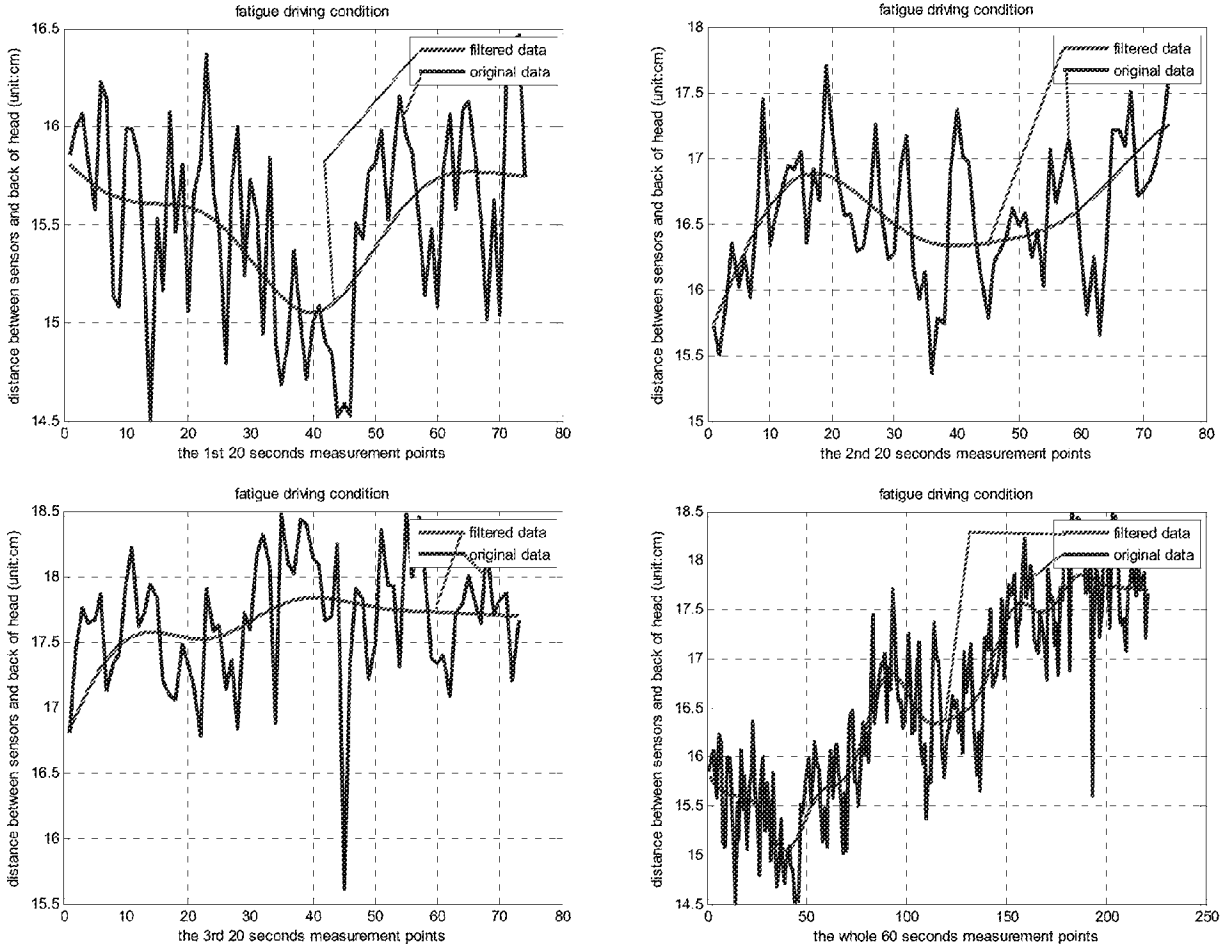
FIG. 4 shows distance sample points in the drowsy driving condition.

FIG. 4 shows that the data from a drowsy driver have relatively large fluctuations compared to that of an unimpaired driver. Comparing the 1st 20 s data and the 2nd 20 s data, there appears to be some periodicity, but the 3rd 20 s does not show this trend, and the distance curve of sample points in a one-minute time period shows that the periodic signal is not a global trend (i.e. does not persist for the entire one-minute time period). The reason for the lack of a global trend for the complete one-minute measurement period is likely to be similar to the unimpaired driving condition, i.e., the driver's head may exhibit random movements that are superimposed on the regular periodic head-sway signals that occur when the driver is in a drowsy driving state.

Figure 5:
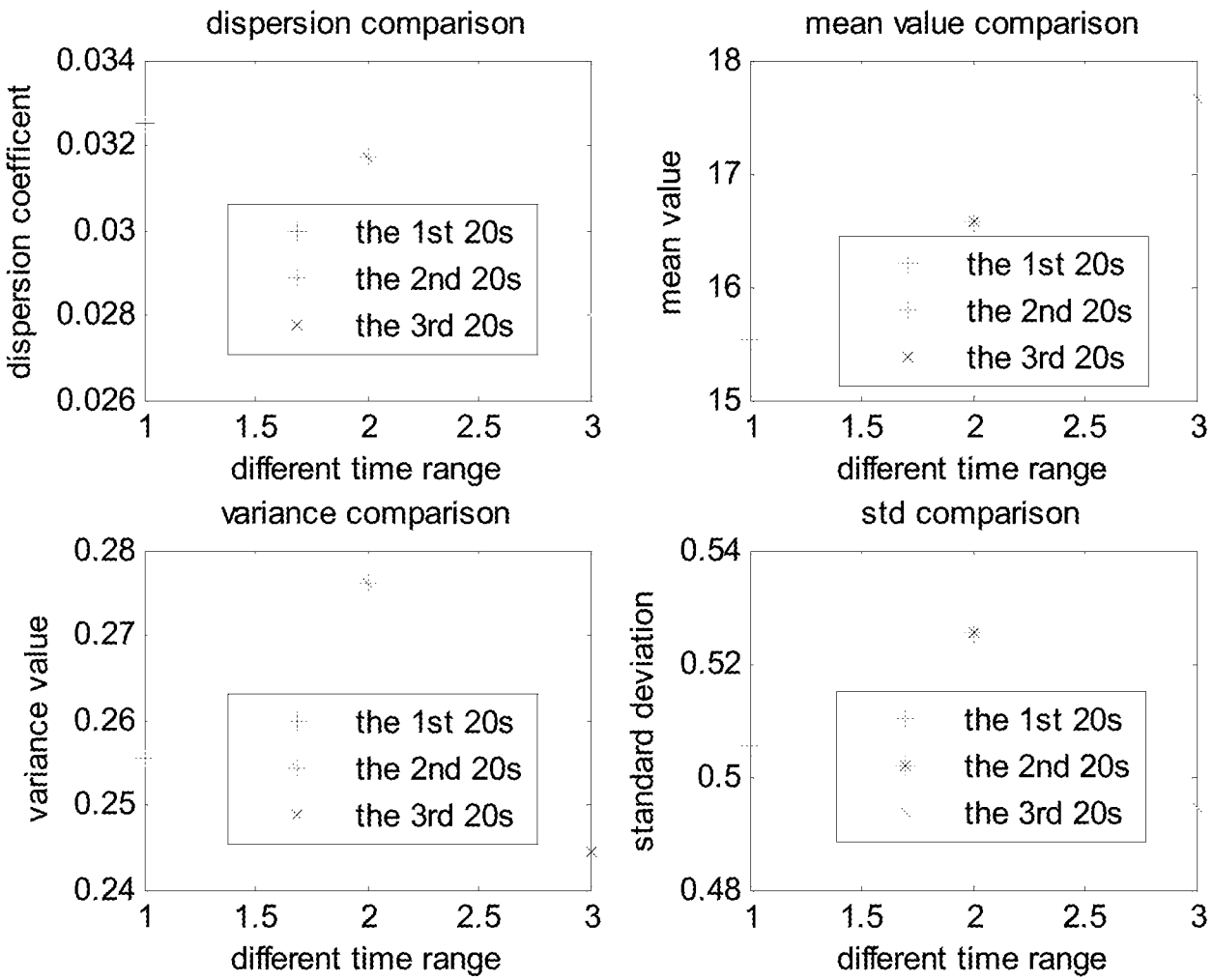
FIG. 5 shows a dispersion coefficient in the drowsy driving condition.

From the graph in FIG. 5, differences can be seen in the dispersion coefficients between the three groups: the 3rd group data have smallest value, the 1st group the largest, which denote the 3rd group 20 s measurement data have a relatively large deviation. For variance, the 3rd group data have relatively small values, compared to the normal, unimpaired driving state.

This feature is unique to periodic signals. Below is a discussion of determining the specific threshold value and range.

The difference between the highest and lowest dispersion coefficient is 0.004, compared to the previous value 0.05 in regular normal driving condition (i.e. unimpaired). The extreme difference of the quasi-periodic signal in the drowsy state is much less than that of random signals obtained from a driver's head movements in the regular normal driving state.

Figure 6:
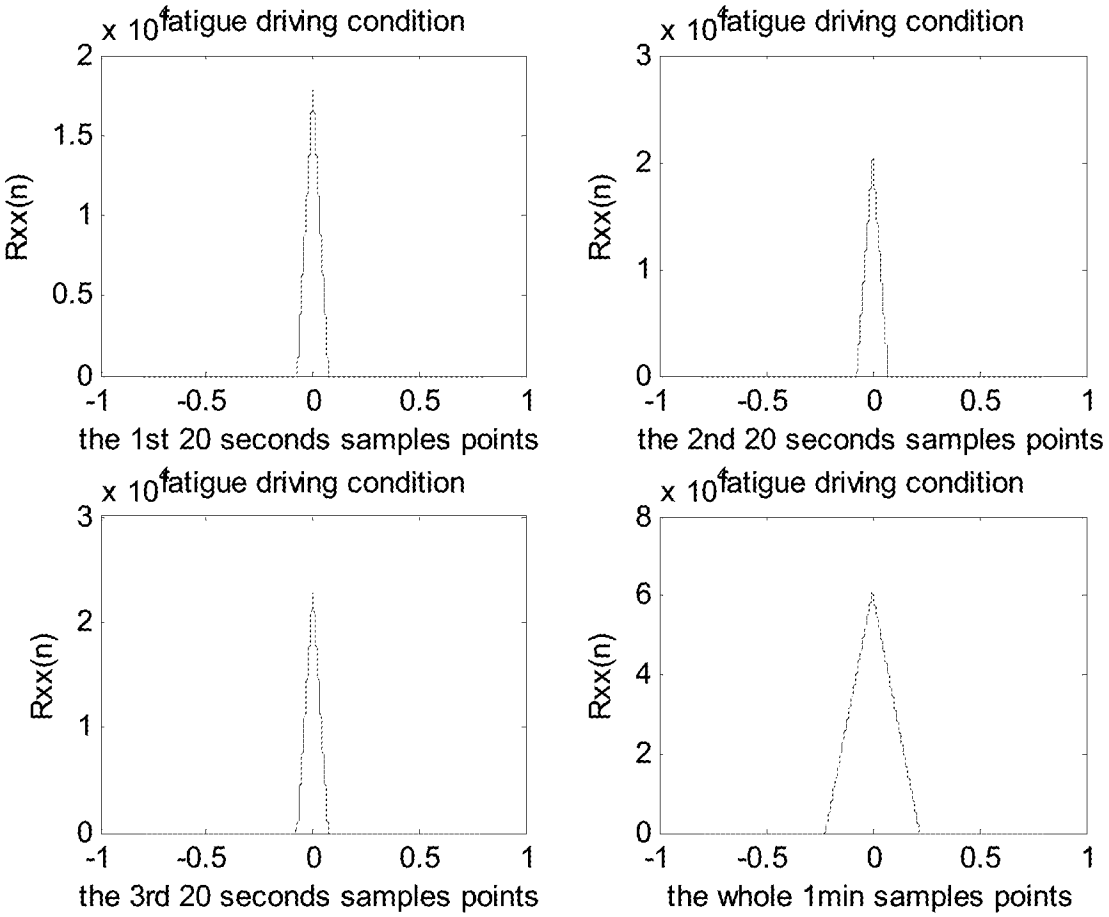
FIG. 6 shows an auto-correlation function in the drowsy driving state.

FIG. 6 presents individual auto-correlation values obtained from measurements of a driver in the drowsy driving state. From the graph, there is not a clear periodic signal evident in this case, but its character shows some differences from the random head motion in regular normal driving state.

The signal regularity will be disclosed below by means of further experimental result simulations. As for the normal-fatigue driving condition (i.e. a driver who is fatigued but not drowsy), its curve and dispersion coefficient is located between the other situations, i.e. the unimpaired driver and the drowsy driver.

For the 1 min regular normal driving analyzed in the time domain data, the conclusions are similar to the foregoing regular normal driving state, i.e., dispersion coefficients obtained in this latter simulation were comparable to those obtained in the simulations described above. As for the auto-correlation function, it shows no periodic signal.

Similar conclusions were reached for simulations obtained when collecting simulation data for 1 min, 2 min, and 3 min for regular normal driving and analyzed in the time domain.

Figure 7:
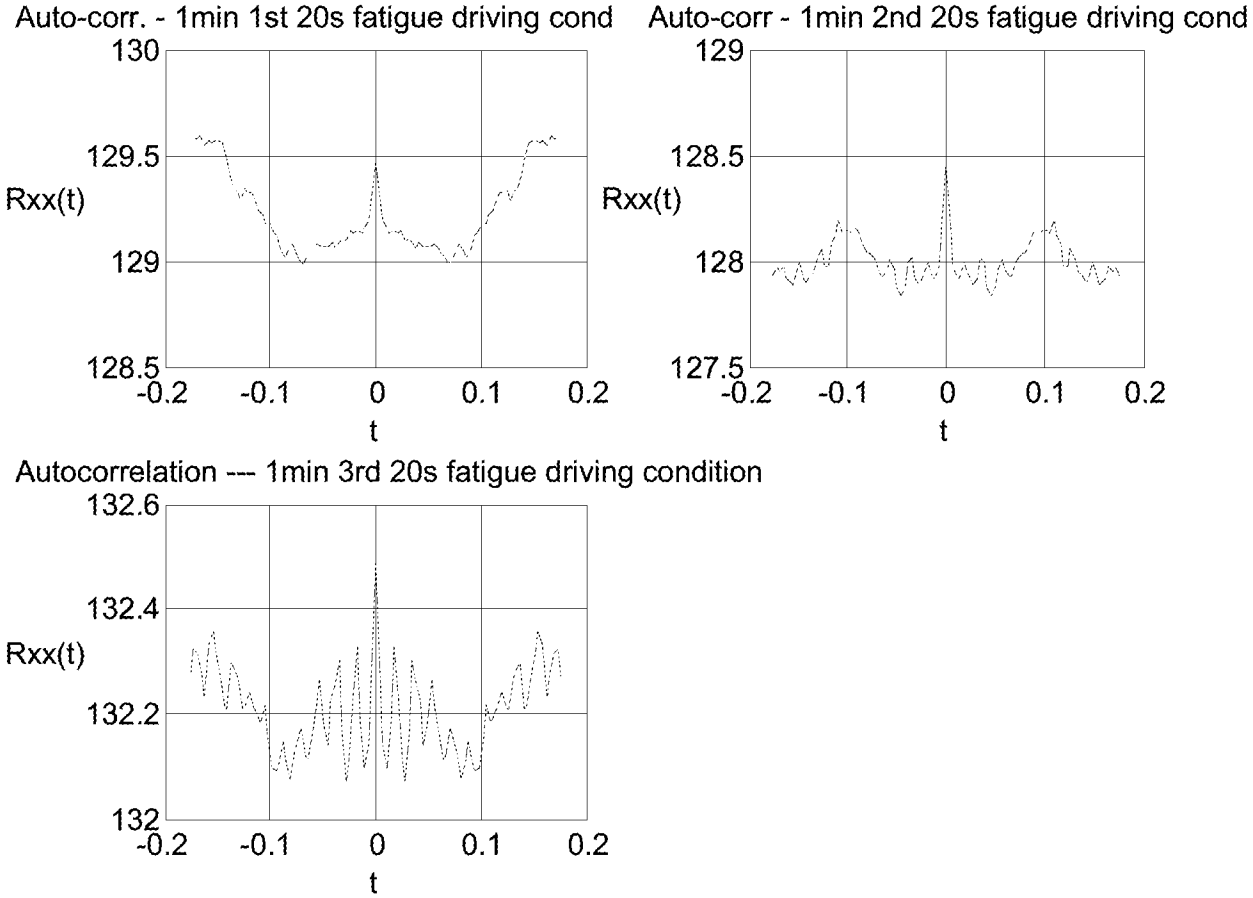
FIG. 7 shows an auto-correlation function in the drowsy driving state.

For 1 min simulation data for drowsy driving analyzed in the time domain, the conclusions are similar to those discussed above for the drowsy driving state. In this simulation, the extreme difference of the dispersion comparison is 0.0085, which is far less than that of regular normal driving signal. From FIG. 7 it can be seen that there is a quasi-periodic signal existing in the case of 1 min simulation data for drowsy driving analyzed in the time domain, which shows different curves from those of the normal driving state. However, the signal in the first case (1st 20 s) is weaker compared to that of both of the other cases (2nd and 3rd 20 s), while the third one (3rd 20 s) has the strongest power among them and displays a clear quasi-periodic signal and gives a rough period value. This is valuable important information which permits us to further verify our algorithm using frequency domain analyses.

For simulations of 1 min, 2 min, and 3 min of drowsy driving analyzed in the time domain, the conclusions are similar to the foregoing drowsy driving state. This data also shows that if the head motion only shows a certain quasi-periodicity or periodicity, the disclosed algorithms are likely to be able to detect the signal in both the time domain and the frequency domain.

Figure 8:
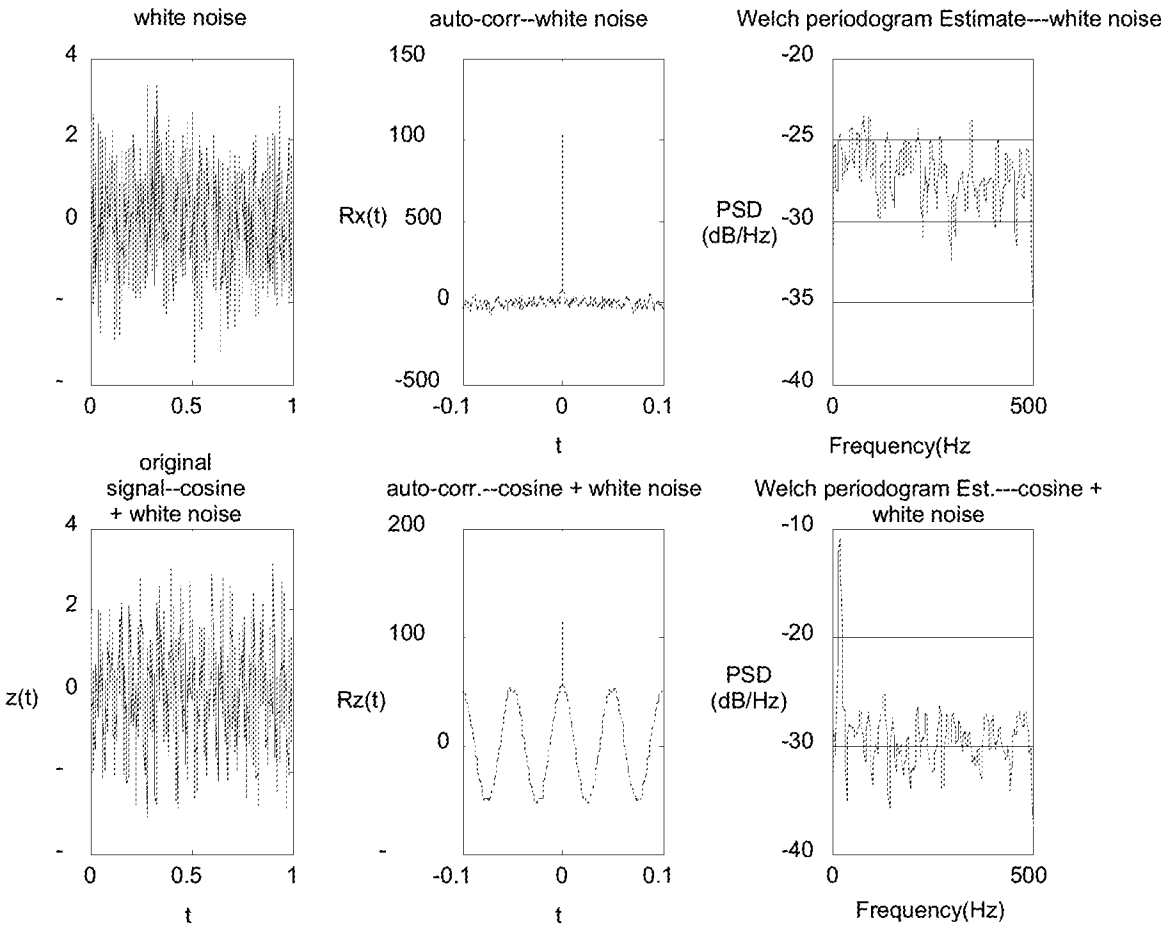
FIG. 8 shows auto-correlation and spectrum estimates of white noise and cosine waveform plus white noise.

FIG. 8 shows simulation results and analyses in the frequency domain. First of all, the method of power spectrum estimation of signals is shown to efficiently detect periodical or quasi-periodical signals. In addition, the auto-correlation function discussed above can also play the same important role in the signal detection.

From FIG. 8 it can be seen that the auto-correlation can be up to maximization when there is no delay, but is zero on other time delay points for white noise. In addition, the power spectrum density (PSD) is distributed uniformly across the frequency axis, which suggests that there is no periodical signal in it. Conversely, combining a cosine signal plus white noise produces periodical signals which can be detected using both auto-correlation and power spectrum density estimation. Thus, the periodical values of signals can be detected by means of the auto-correlation or power spectrum density.

Figure 9:
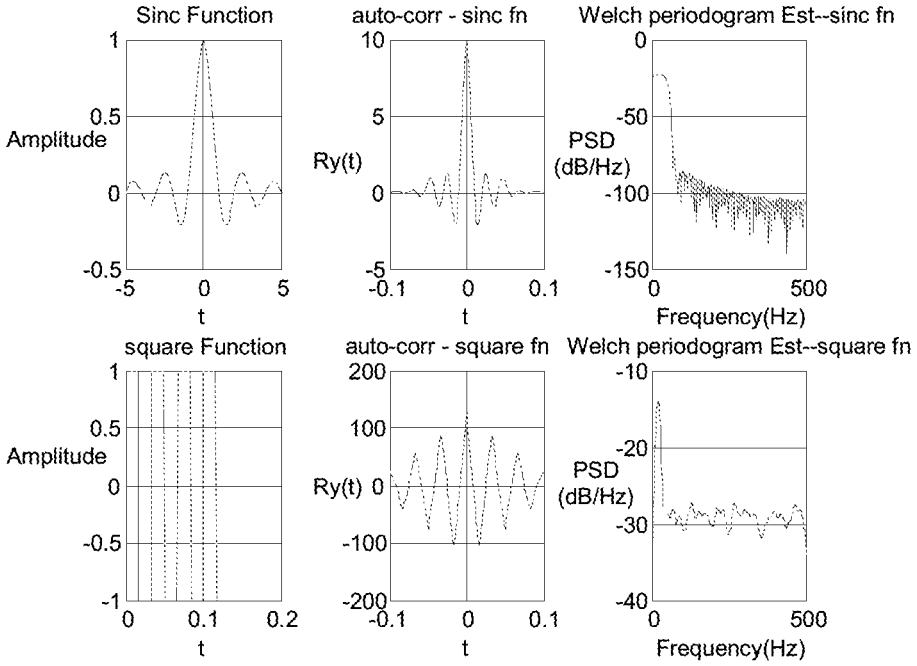
FIG. 9 shows auto-correlation and spectrum estimates of sine function and square waveform.

FIG. 9 also shows the same conclusion with FIG. 8 and confirms that the disclosed algorithms are very effective if the head motion displays a quasi-periodic signal.

Figure 10:
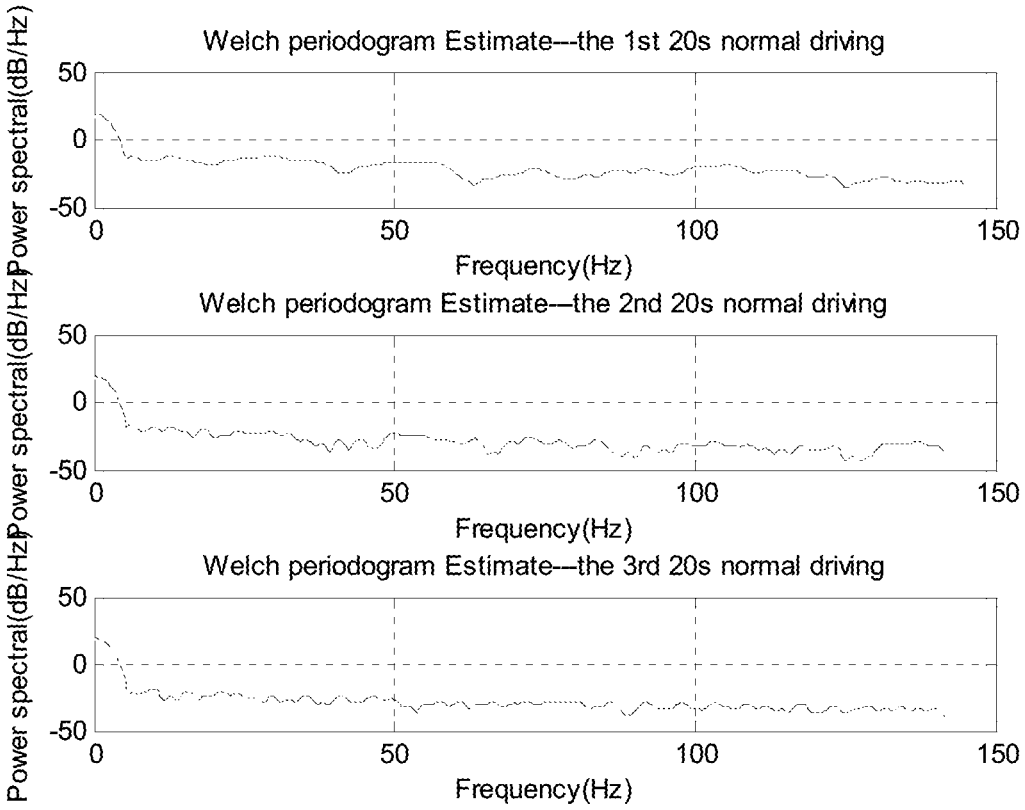
FIG. 10 shows a spectrum estimate in 1 min regular normal driving state.
Figure 11:
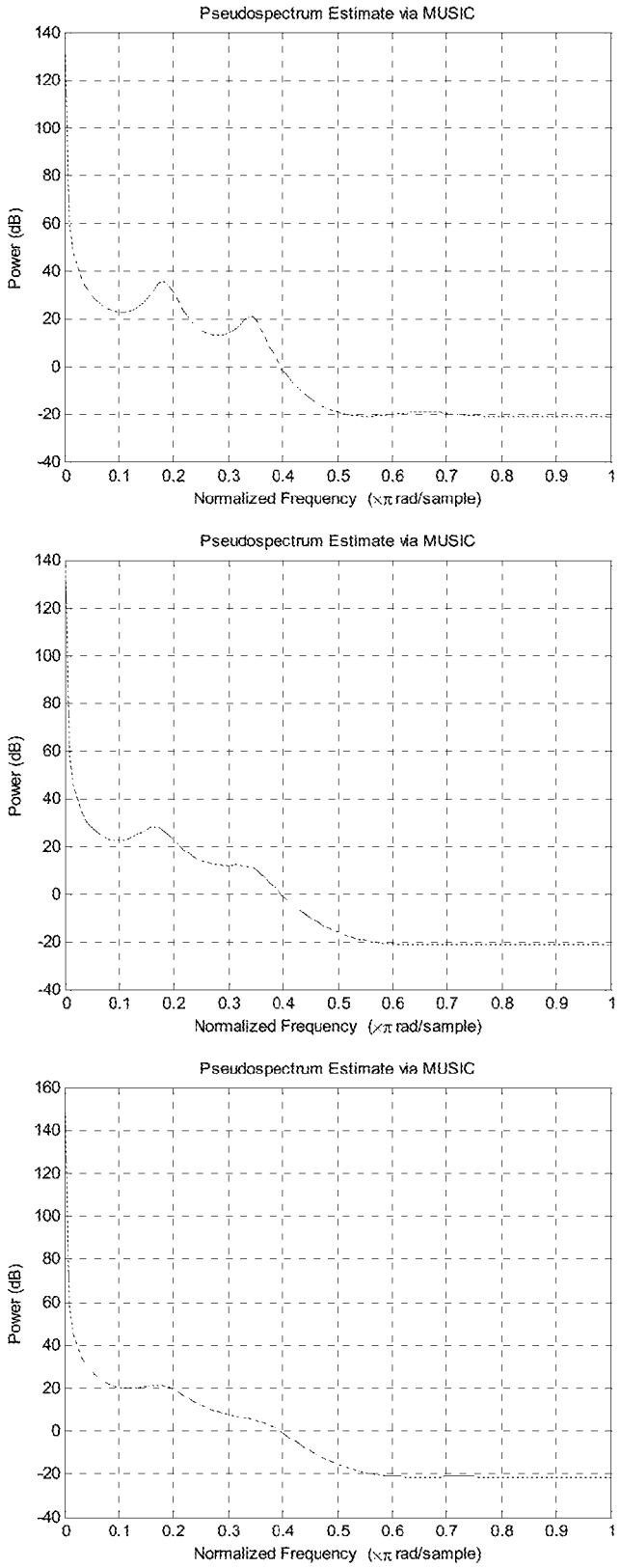
FIG. 11 shows a MUSIC estimation in 1 min regular normal driving state.

FIG. 10 shows data obtained from 1 min of measurements of a regular normal driving condition. From the frequency domain data in FIG. 10, there does not appear to be a clear single power level that is stronger than other signals. The stronger signal would be expected at a lower frequency, but the lower frequencies in FIG. 10 do not show an evident period. Thus, FIG. 11 provides further analysis of the data. FIG. 11 shows results of applying the MUSIC (Multiple Signal Classification) power spectrum estimation algorithm of high-order spectrum estimation theory in our cases.

From the graph, although the 1st 20 s spectrum estimation has two spectrum peaks, neither is very strong and thus it is difficult to judge whether one or both is significant. Thus, further analyses may be needed to determine the threshold.

Figure 12:
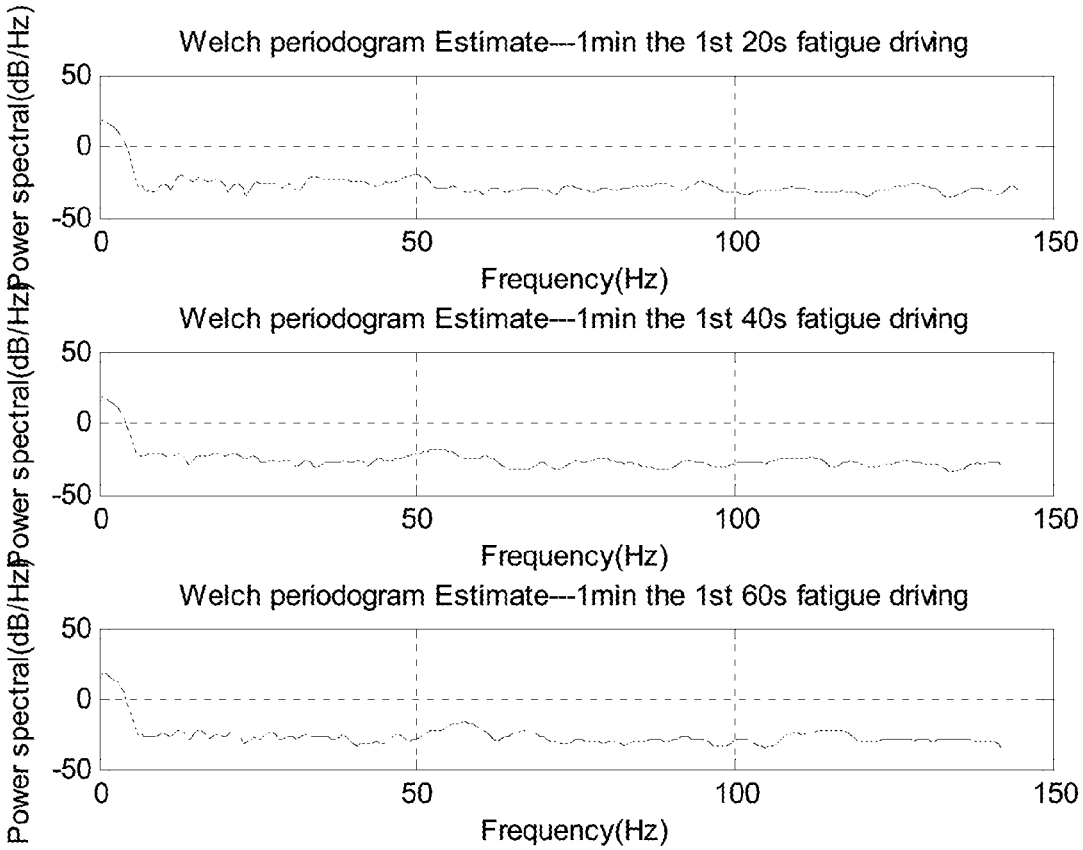
FIG. 12 shows a spectrum estimate in a one-minute drowsy driving state.

FIG. 12 shows data obtained from 1 min of measurements of a driver in a regular drowsy driving state. From the data in FIG. 12 it is not evident which frequency signal has stronger power than others. Again, the MUSIC algorithm is applied to extract more information from the signals, as shown in FIG. 13.

Figure 13:
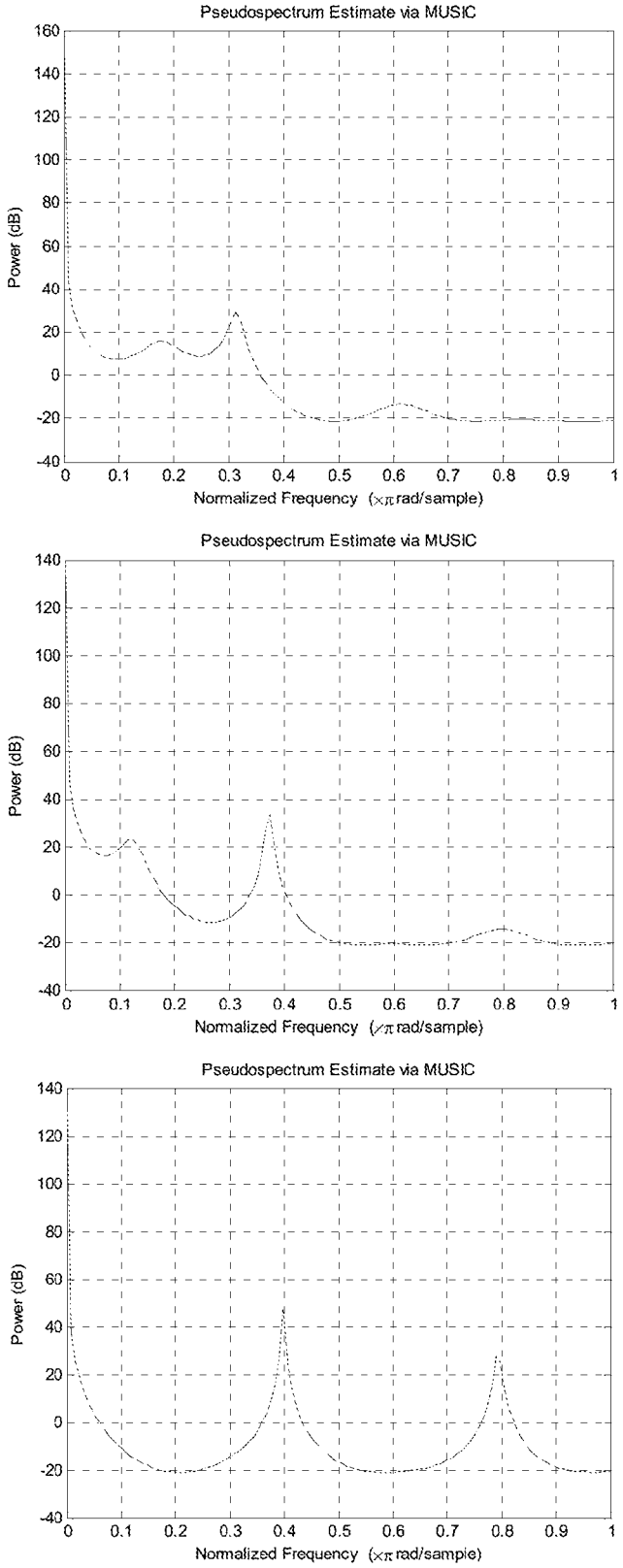
FIG. 13 shows a MUSIC estimation in 1 min drowsy driving state.

From the graph in FIG. 13, although the 1st 20 s spectrum estimation has one spectrum peak, the 2nd 20 s displays a signal peak with stronger power (higher peak), and the data from the 3rd 20 s segment shows two strong periodic signal occurrences.

From the data of FIG. 13, a conclusion can be drawn that there are two quasi-periodic signals in the head motion detections in the 3rd 20 s data segment from the 1 min measurement period, which indicates that the head motion shows both regular quasi-periodic signals in the process. Thus, the analyses of simulation results using the MUSIC algorithm are consistent with those of the aforementioned auto-correlation and dispersion coefficient, but provide more details hidden in signals.

From data such as that shown above, in particular the data of FIG. 13, appropriate thresholds are determined which can be used to automatically detect when a driver has periodic head motions that are indicative of a drowsy driving state. When such periodic motions are detected, steps are taken to alert the driver, e.g. by making a sound or flashing a light to catch the driver's attention to his or her drowsy state. The alerting mechanism may be located in one or more locations to gain the driver's attention, such as on or in the headrest or other portions of the seat or seatback, the dashboard, the steering wheel, the visor, or the roof (e.g. see locations of sensors in FIG. 15).

Figure 14:
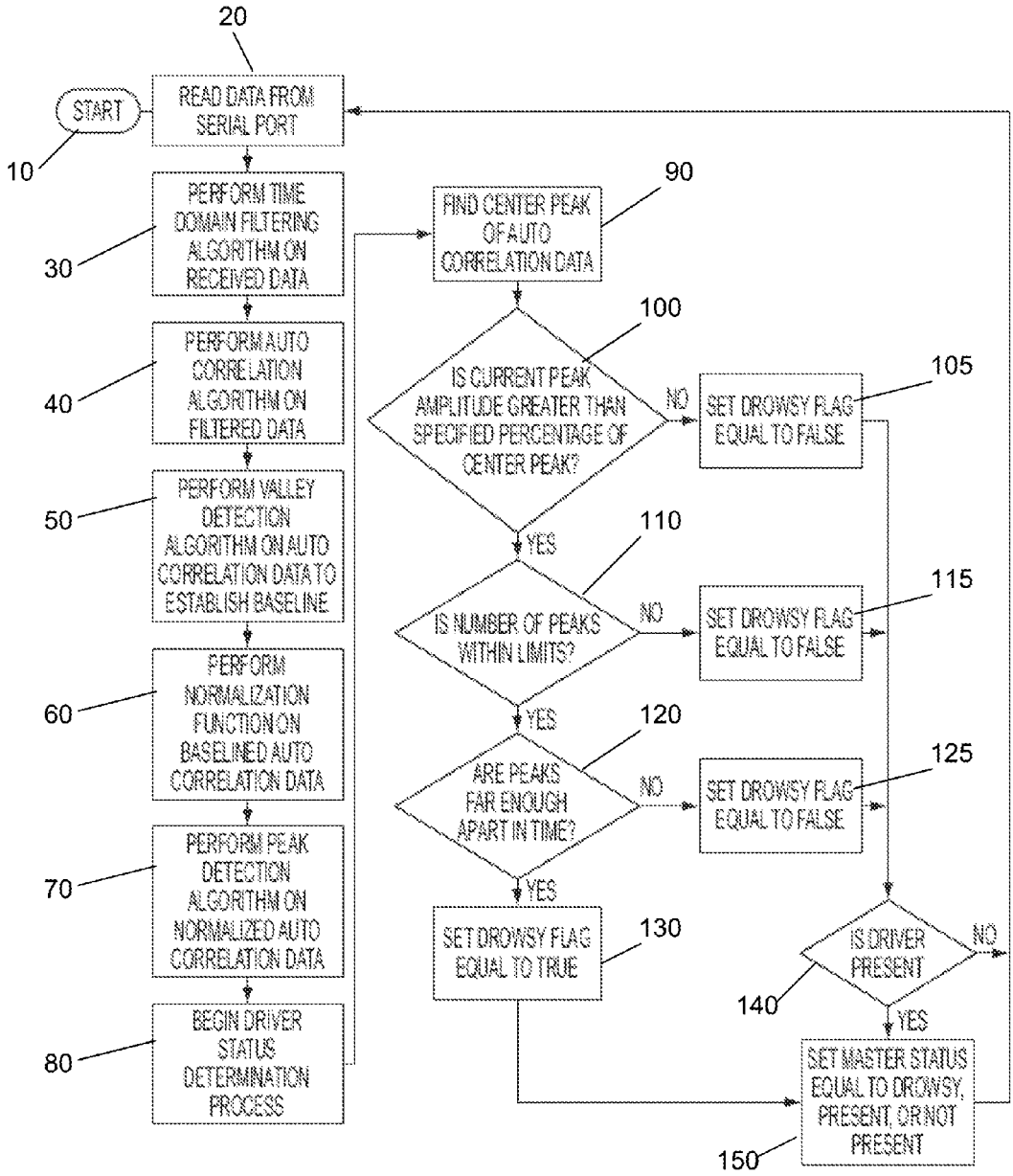
FIG. 14 shows a flow chart that could be used to generate software for implementing embodiments of the invention.

FIG. 14 is a flow chart of an algorithm for performing detection of head movements, analysis of collected data, and notification of a driver in accordance with embodiments of the invention. In various embodiments, the algorithm of FIG. 14 is carried out using a computing system such as that described below for FIG. 15. The attached Appendix provides a further disclosure of the mathematical analyses used in the present invention. At the start 10 of the algorithm of FIG. 14, data is read from the serial port of the computing system in step 20. In step 30, the computing system performs a time domain filtering algorithm on the received data. In step 40, the computing system performs an auto-correlation algorithm on the filtered data from step 30. In step 50, the computing system performs a valley detection algorithm on the auto-correlation data of step 40 to establish a baseline. In step 60, the computing system performs a normalization function on the baselined auto-correlation data of step 50. In step 70, the computing system performs a peak detection algorithm on the normalized auto-correlation data of step 60. In step 80, the computing system begins a driver status determination process. In step 90, the computing system finds a center peak of the auto-correlation data. In step 100, if the current peak amplitude is greater than specified percentage of center peak, then the system proceeds to step 110. If not, then the system sets the drowsy flag to false in step 105. In step 110, the system determines whether the number of peaks is within limits, and if so then proceeds to step 120, and if not the system sets the drowsy flag to false in step 115. In step 120, the system determines whether the peaks are far enough apart in time, and if so then the system sets the drowsy flag to true in step 130, and if not the system sets the drowsy flag to false in step 125. If the drowsy flag is set to false in step 105, 115, or step 125, then the system determines at step 140 whether the driver is present (e.g. if no movement is detected at all, or using data from other sensors such as seat weight sensors) and if not then the system returns to step 20. If the driver is present in step 140 or if the drowsy flag is set to true in step 130, then in step 150 the master status is set as appropriate to drowsy, present, or not present, and control returns to step 20.

Figure 15:
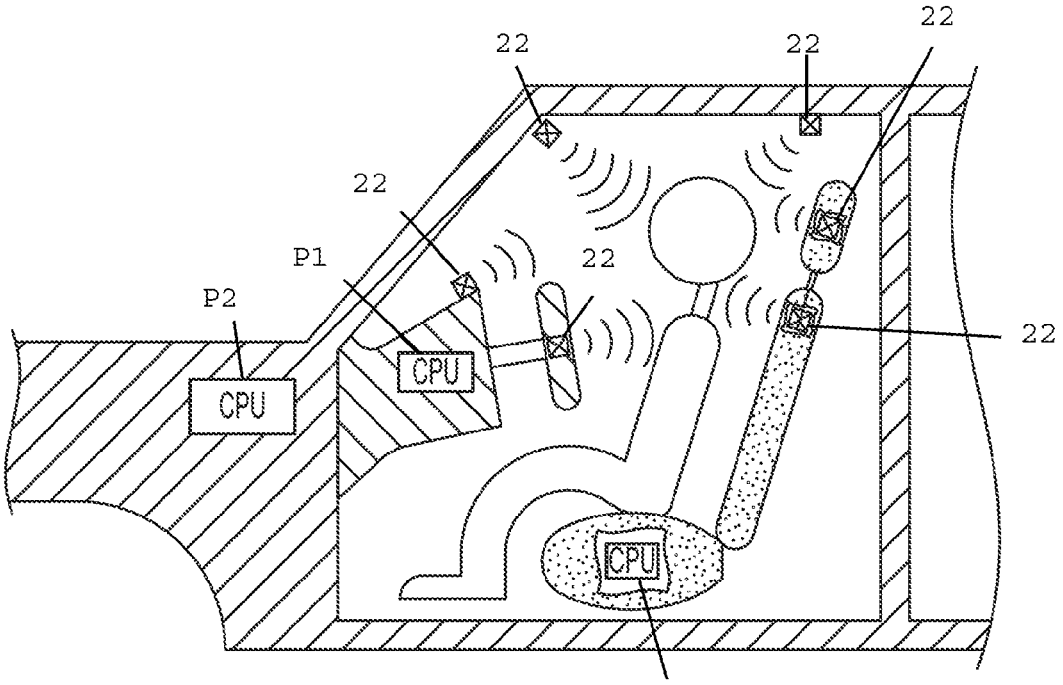
FIG. 15 shows a diagram of possible locations for a computing system as well as for one or more sensors in a vehicle.

As discussed above, the detector may be an ultrasonic detector and may be situated at one or more locations in the vehicle where the system is employed, including on or in the headrest or other portions of the seat or seatback, the dashboard, the steering wheel, the visor, or the roof (FIG. 15). In FIG. 15, an exemplary system includes a central processing unit ("CPU") 20 (which may take the form of a microprocessor or similar device) and may be located in a number of different locations, including the locations designated P1, P2, and P3. One or more sensor 22 communicated with the CPU 20. The vehicle may be a car, truck, train cab, ship, airplane, or other type of vehicle in which monitoring the driver's alertness is desired. The data that is collected is transmitted (e.g. by wire or via wireless mechanisms) to a computing system (such as the CPU 20), typically within the vehicle although the data could also or instead be transmitted to a remote location for analysis and monitoring. The computing system may also be housed in a single unit with the detector(s). The computing system may be integrated into or be housed along with other vehicle computing systems. The computing system may be located in or under the dashboard, the seat, or other suitable location (FIG. 15). The computing system can include a processor, memory, communication mechanisms (e.g. for receiving data from the detectors as well as transmitting signals to the driver or other vehicle systems, and/or to a remote location), other input/output mechanisms (e.g. for inputting software updates, changing settings, troubleshooting, notifying the driver of drowsiness or of possible system errors), and computer-readable media (e.g. flash memory or a hard drive to name a few possibilities) for storing program and data information and for maintaining a log of collected and analyzed data.

Figure 16:
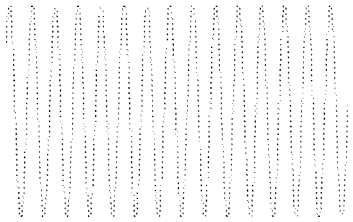
FIG. 16 shows a simple sine wave.

The autocorrelation function as used in embodiments of the present invention is achieved by taking the cross-correlation of a dataset with itself. The cross-correlation serves to accentuate similarities between datasets. In the case of the autocorrelation function, it serves to accentuate periodicity in a data set. Take for example a simple sine wave, as shown in FIG. 16.

Figure 17:
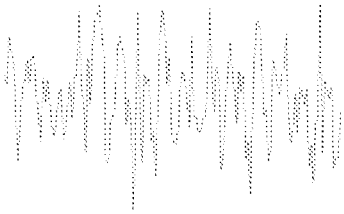
FIG. 17 shows a signal with a small signal-to-noise ratio.

When the signal-to-noise ratio is small, it is difficult to distinguish the desired signal from the background noise, as shown in FIG. 17.

Figure 18:
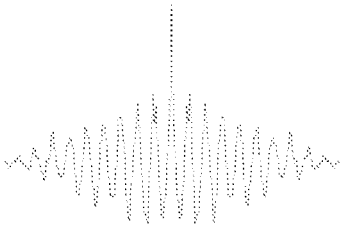
FIG. 18 shows the result of performing an autocorrelation function on the signal of FIG. 17.

However, the autocorrelation function brings out the periodicity in the data, as shown in FIG. 18.

Figure 19:
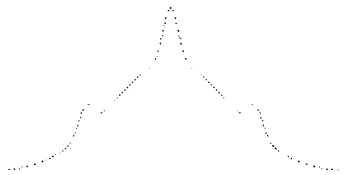
FIG. 19 shows an example of performing an autocorrelation function on a signal including a head nod associated with drowsiness.

The autocorrelation function has the same period as the underlying signal, with an improved signal-to-noise ratio. In the case of the head nod associated with drowsiness, the autocorrelation looks more like what is shown in FIG. 19.

Figure 20:
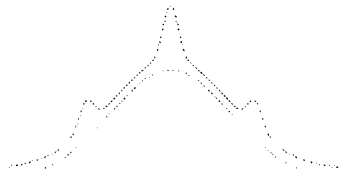
FIG. 20 shows the trace of FIG. 19 with a second trace indicating a background signal.

There is in fact a broad background signal established by the non-zero rest position of the occupant's head, illustrated here by the dashed line, as shown in FIG. 20.

Figure 21:
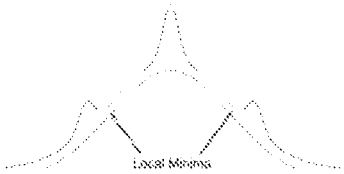
FIG. 21 shows the trace of FIG. 20 in which the local minima have been identified.
Figure 22:
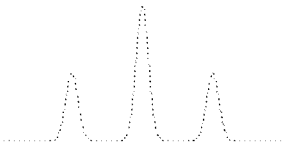
FIG. 22 shows the trace of FIGS. 20 and 21 in which a background level has been subtracted from the data.

In order to correctly extract the head nod this baseline must be first subtracted from the data. This is accomplished by first looking for local minima (valley detection) in the dataset and fitting these minima with a polynomial in order to subtract from the entire data set, as shown in FIGS. 21 and 22.

The baseline-corrected dataset is then searched for local maxima (peak detection) to determine the quasi-periodicity of the dataset. If the data meet the proper criteria (amplitude of movement, periodicity, etc.) then a series of head nods has been detected and the proper flag is set.

What is claimed is:

1. A method for monitoring the alertness of an operator of a vehicle, the method comprising:

using a sensor to detect a first plurality of positions of the operator's head relative to the sensor during a first period of time;

calculating a first set of head movement data using the first plurality of positions of the operator's head detected during the first period of time;

calculating a first power spectrum of the first set of head movement data;

using the sensor to detect a second plurality of positions of the operator's head relative to the sensor over a second period of time;

calculating a second set of head movement data using the second plurality of positions of the operator's head detected during the second period of time;

calculating a second power spectrum of the second set of head movement data;

comparing the second power spectrum to the first power spectrum to determine whether the second power spectrum has a greater magnitude than the first power spectrum at a characteristic frequency to evaluate the alertness of the operator;

using the sensor to detect a third plurality of positions of the operator's head relative to the sensor over a third period of time;

calculating a third set of head movement data using the third plurality of positions of the operator's head detected during the third period of time;

calculating a third power spectrum of the third set of head movement data; and comparing the third power spectrum to the first power spectrum to determine whether the third power spectrum has a greater magnitude than the first power spectrum at a characteristic frequency to evaluate the alertness of the operator during the third period of time.

2. The method of claim 1, wherein the sensor comprises an ultrasonic sensor.

3. The method of claim 1, wherein the sensor is located behind the operator.

4. The method of claim 1, wherein the sensor is located in front of the operator.

5. The method of claim 1, wherein the head movement data comprises changes in the positions of the driver's head.

6. The method of claim 1, further comprising alerting the operator when it is determined that the operator is impaired.

7. The method of claim 6, wherein alerting the operator includes using at least one of an audible alarm and a visual alarm.

8. The method of claim 1, wherein the operator is alert during the first period of time.

9. The method of claim 1, wherein the alertness of the operator during the second period of time is unknown.

10. A system for monitoring the alertness of an operator of a vehicle, the system comprising:

at least one sensor for detecting the position of the operator's head relative to the sensor; and a controller operatively coupled to the sensor, the controller configured to use the sensor to detect a first plurality of positions of the operator's head relative to the sensor during a first period of time, calculate a first set of head movement data using the first plurality of positions of the operator's head detected during the first period of time, calculate a first power spectrum of the first set of head movement data;

use the sensor to detect a second plurality of positions of the operator's head relative to the sensor during a second period of time, calculate a second set of head movement data using the second plurality of positions of the operator's head detected during the second period of time, calculate a second power spectrum of the first set of head movement data, compare the second power spectrum to the first power spectrum to determine whether the second power spectrum has a greater magnitude than the first power spectrum at a characteristic frequency to evaluate the alertness of the operator, use the sensor to detect a third plurality of positions of the operator's head relative to the sensor over a third period of time, calculate a third set of head movement data using the third plurality of positions of the operator's head detected during the third period of time, calculate a third power spectrum of the third set of head movement data, and compare the third power spectrum to the first power spectrum to determine whether the third power spectrum has a greater magnitude than the first power spectrum at a characteristic frequency to evaluate the alertness of the operator during the third period of time.

11. The system of claim 10, wherein the sensor comprises an ultrasonic sensor.

12. The system of claim 10, wherein the sensor is located behind the operator.

13. The system of claim 10, wherein the sensor is located in front of the operator.

14. The system of claim 10, wherein the head movement data comprises changes in the positions of the driver's head.

15. The system of claim 10, wherein the controller is further configured to alert the operator when it is determined that the operator is impaired.

16. The system of claim 15, wherein the controller alerts the operator using at least one of an audible alarm and a visual alarm.

17. The system of claim 10, wherein the operator is alert during the first period of time.

18. The system of claim 10, wherein the alertness of the operator during the second period of time is unknown.

* * * * *